US011203953B1

(12) United States Patent
Ahmed et al.

(10) Patent No.: US 11,203,953 B1
(45) Date of Patent: Dec. 21, 2021

(54) THREE ROLLER SWITCHABLE FINGER FOLLOWER

(71) Applicant: Schaeffler Technologies AG & Co. KG, Herzogenaurach (DE)

(72) Inventors: Faheem Ahmed, Rochester Hills, MI (US); Sumukha Nagaraj, Beverly Hills, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/022,643

(22) Filed: Sep. 16, 2020

(51) Int. Cl.
*F01L 1/18* (2006.01)
*F01L 1/46* (2006.01)

(52) U.S. Cl.
CPC ..... *F01L 1/185* (2013.01); *F01L 2001/186* (2013.01); *F01L 2001/467* (2013.01)

(58) Field of Classification Search
CPC ..... F01L 1/185; F01L 2001/186; F01L 2001/467
See application file for complete search history.

(56) References Cited

U.S. PATENT DOCUMENTS 6,325,030 B1 12/2001 Spath et al.
6,439,179 B2 8/2002 Hendriksma et al.
6,481,400 B2 11/2002 Hendriksma et al.
6,502,536 B2 1/2003 Lee et al.
6,532,920 B1 3/2003 Sweetnam et al.
7,174,869 B2 2/2007 Praschko et al.
7,909,007 B2 3/2011 Manther et al.
10,196,944 B2 2/2019 Evans et al.
2015/0128890 A1* 5/2015 Cecur ..... F01L 1/18 123/90.16
2019/0072011 A1 3/2019 Cecur et al.

FOREIGN PATENT DOCUMENTS

DE 102017110456 11/2018
DE 102017129874 6/2019
DE 102017130277 6/2019

* cited by examiner

*Primary Examiner* — Zelalem Eshete
(74) *Attorney, Agent, or Firm* — Volpe Koenig

(57) ABSTRACT

A switchable finger follower, including an inner lever and an outer lever. The outer lever includes a pocket defined by two outer arms that extend along longitudinal sides of the inner lever. The outer lever is mounted for pivoting movement at the first end of the inner lever by a pivot axle, and a respective outer roller is separately mounted on an outer side of each of the two outer arms. A coupling device is located on one of the inner or outer levers and has a coupling pin arranged to move between a locking position, in which the inner and outer levers are connected together for movement in an activation direction, and an unlocked position, in which the inner lever is pivotable relative to the outer lever. A method of assembling a finger lever with outer rollers connected to the two outer arms is also provided.

19 Claims, 3 Drawing Sheets

THREE ROLLER SWITCHABLE FINGER FOLLOWER

TECHNICAL FIELD

The invention relates to roller finger followers that are used in overhead cam-type internal combustion engines and, more particularly, to switchable roller finger followers that have a high lift and a low or no lift mode.

BACKGROUND

Switchable roller finger followers are known. See, for example, U.S. Pat. No. 7,174,869. Such finger followers have an outer lever pivotably mounted outside an inner lever and a roller rotatably mounted on a transverse axle in a slot in the inner lever. Here, the top surface of the outer lever can act as a contact surface for a high lift cam and the top surface of the roller acts as a contact surface for a low lift cam. A coupling element is mounted at one end of the finger follower and oil from an oil source is used to activate the coupling element. When the coupling element is activated, it locks the outer lever to the inner lever and requires the follower to follow the high lift cam and transfer the lift to the valve stem of an associated intake or exhaust valve. When the coupling element is deactivated, the outer lever is free to pivot relative to the inner lever, with the motion being absorbed by a lost-motion spring, and the motion of the low lift cam is transferred by the inner lever to the valve stem. This movement by the outer lever is conventionally referred to as the lost motion stroke.

Conventionally, the outer lever is a unitary structure such that the coupling element need only operate on one part of the outer lever. Typically, the coupling device operates on a yoke portion of the outer lever, the yoke portion being transverse to the longitudinal axis of the finger follower. Conventionally, the roller axle is staked to the inner lever to maintain its lateral position relative to the inner lever. U.S. Pat. No. 7,909,007 discloses a roller finger follower of this type. This provides a lost motion spring to maintain contact between the cam follower and the cam.

One issue in these prior known adjusters is the friction generated by the sliding surface contact with the outer lever. U.S. 2019/0072011 discloses a valve train assembly with a switchable finger follower having an inner roller supported on the inner arm and outer rollers supported on the outsides of both outer arms that are supported on a common axle that extends through an oversized opening in the inner lever axle that supports the inner roller on the inner arm.

It would be desirable to provide a switchable finger follower of the general type noted above with simple manufacturing, as well as improved performance.

SUMMARY

Briefly stated, a switchable roller finger follower having at least two lift modes for a valve train of an internal combustion engine is provided that includes an inner lever having first and second ends, a slot between the first and second ends, and a roller mounted in the slot, and an outer lever with a pocket defined by two outer arms that extend along longitudinal sides of the inner lever, with the outer lever being mounted for pivoting movement at the first end of the inner lever by a pivot axle. A respective outer roller is separately mounted on an outer side of each of the two outer arms. A lost motion spring is connected between the inner lever and the outer lever. A coupling device is located on one of the inner lever or the outer lever on an end opposite from the pivot axle, and the coupling device includes a coupling pin arranged to move between a locking position, in which the inner lever and the outer lever are connected together for movement at least in an activation direction of a valve, and an unlocked position, in which the inner lever is pivotable relative to the outer lever. The separate mounting of the outer rollers to the outer arms allows pre-assembly of these components, resulting is simpler and more reliable assembly.

In another aspect, aligned holes extend through the two outer arms, respective first sleeves extend into the holes in each of the two outer arms, and the outer rollers are supported by bearing needles that are radially supported on the first sleeves. The first sleeves may include radially extending flanges that are located on a pocket side of each of the two outer arms.

In another aspect, two retainers are provided, each including a radially extending retainer flange, and the retainers are press fit into respective ones of the first sleeves. Here, the retainer flanges axially retain the outer rollers and the needles. This provides for a simple and secure assembly of the outer rollers to the sleeves.

The retainers may also be formed as sleeves.

In another embodiment, the first sleeves include radially extending flanges that are located outside of the outer rollers and axially retain the outer rollers and the needles.

In another aspect of this embodiment, two retainers are provided, with each including a radially extending retainer flange. The retainers are press fit into respective ones of the first sleeves, and the retainer flanges are located on a pocket side of each of the two outer arms.

The retainers of this embodiment may also be formed as sleeves.

In another aspect, a method of assembling a switchable roller finger follower of the type noted above is provided. The method includes: (a) mounting the roller in the slot in the inner lever using a pin; (b) mounting the outer rollers to the respective outer arms by inserting first sleeves into holes in each of the two outer arms, and radially supporting the outer rollers with bearing needles on the first sleeves; and (c) connecting the outer lever to the first end of the inner lever with the pivot axle.

In the method, the first sleeves may include radially extending flanges, and the sleeves are inserted from a pocket side of each of the two outer arms. Additionally, a further step of can be utilized of press fitting a respective retainer, each including a radially extending retainer flange, into respective ones of the first sleeves, such that the retainer flanges axially retain the outer rollers and the needles.

Alternatively, the method can include the first sleeves having radially extending flanges, and positioning the flanges outside of the outer rollers to axially retain the outer rollers and the needles. A further step of press fitting a respective retainer, each including a radially extending retainer flange, into respective ones of the first sleeves from a pocket side of each of the two outer arms can then be carried out.

Using one or more of these features results in a switchable finger follower with reduced complexity and additional functionality.

Other aspects of the embodiments are described below and in the claims, and have not been repeated here.

BRIEF DESCRIPTION OF THE DRAWINGS

The foregoing Summary and the following detailed description will be better understood when read in conjunction with the appended drawings, which illustrate exemplary embodiments. In the drawings.

DETAILED DESCRIPTION OF THE PREFERRED EMBODIMENTS

Figure 1:
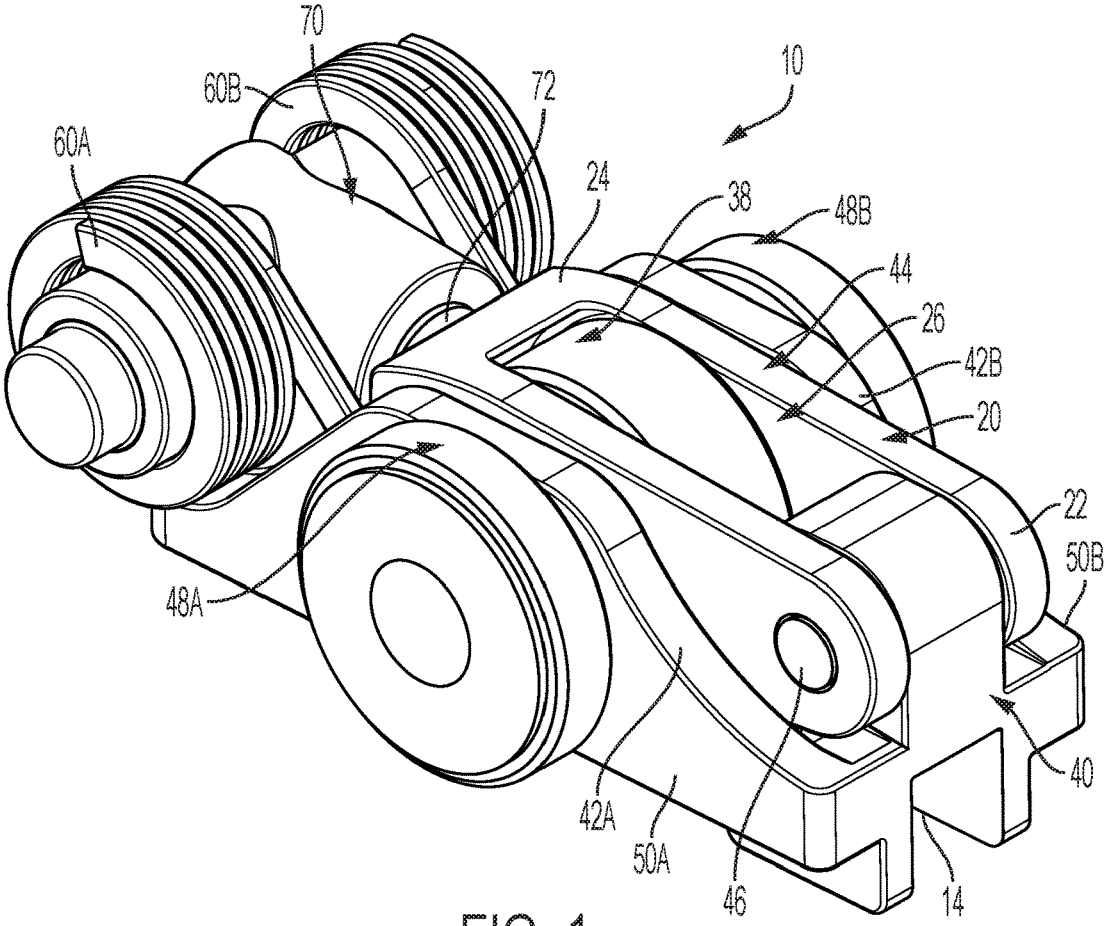
FIG. 1 is a perspective view of a first exemplary embodiment of a switchable roller finger follower.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The term "about" means within +/−10% of a given value. The terminology includes the words specifically noted above, derivatives thereof and words of similar import.

Figure 3:
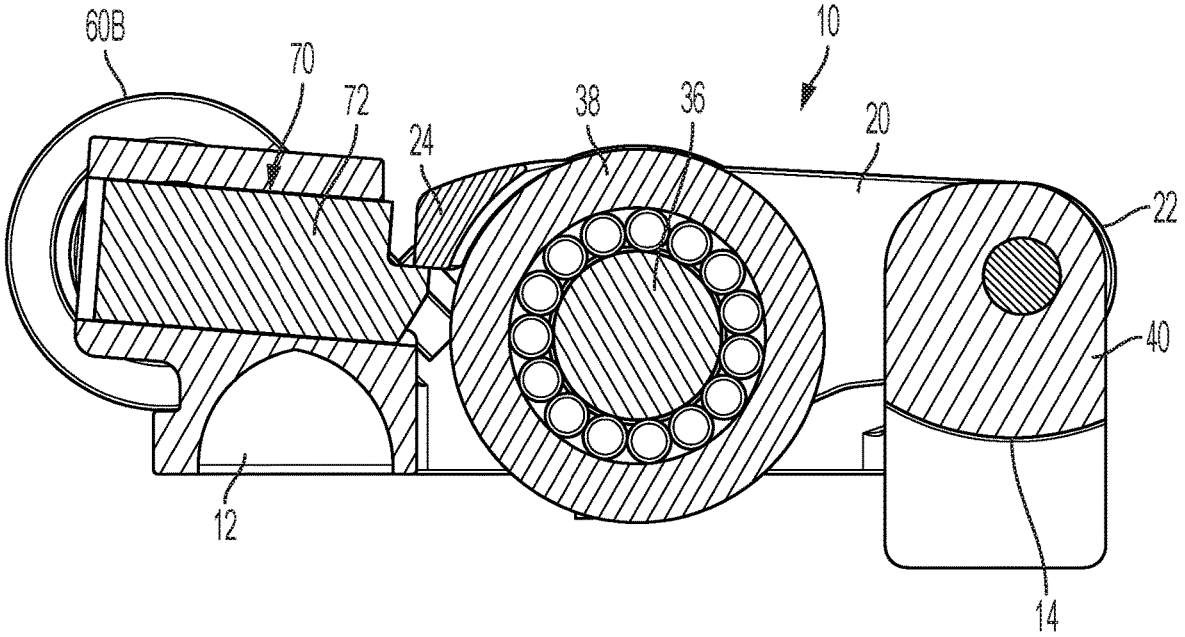
FIG. 3 is a longitudinal, cross-section view of the switchable roller finger follower of FIG. 1.

Referring to FIG. 1, an exemplary embodiment of the switchable roller finger follower 10 is shown. As shown in FIG. 3, the finger follower 10 includes a cup-shaped recess 12 at one end where it is adapted to be supported on a lash adjuster head, and includes a valve stem contact region 14 at the other end where it is adapted to contact and actuate an associated valve of an internal combustion engine. The switchable finger follower 10 has at least two lift modes of operation created by contact with associated cam surfaces of a camshaft for a valve train of an internal combustion engine, not shown. In the first embodiment of the switchable roller finger follower 10, the lift modes are a lift mode and a low or no lift mode which allows an associated valve to be deactivated depending upon the particular operating conditions for the engine.

Figure 2:
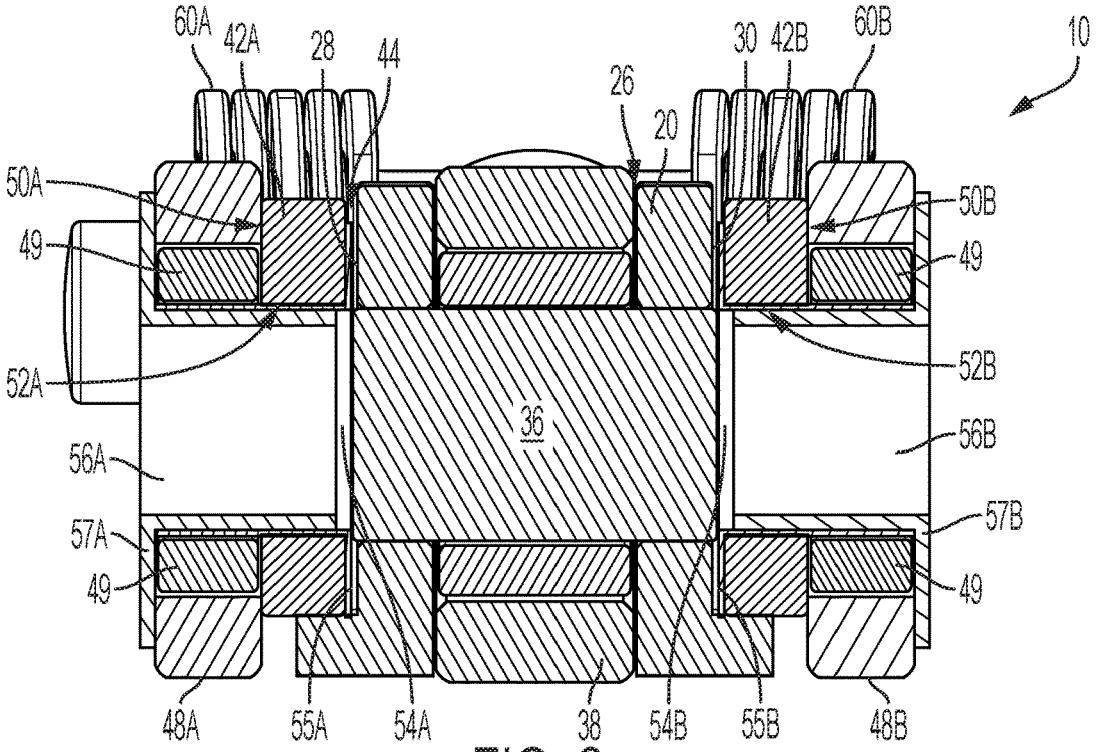
FIG. 2 is a cross-sectional view of a portion of the switchable roller finger follower of FIG. 1.

As shown in FIGS. 1-3, the switchable roller finger follower 10 includes an inner lever 20 having first and second ends 22, 24, as well as a slot 26 located between the first and second ends 22, 24. A roller 38 which forms a first cam contact surface is mounted in the slot 26, preferably using a pin 36. In the embodiment shown, the roller 38 is mounted with needles 39, providing a rolling bearing for the roller 38, which reduces friction.

An outer lever 40 is provided that has a pocket 44 defined by two outer arms 42A, 42B that extend along longitudinal sides 28, 30 of the inner lever 20. The outer lever 40 is mounted for pivoting movement at the first end 22 of the inner lever 20 by a pivot axel 46. This extends through aligned holes in the inner lever 20 and outer lever 40 and is either press fit or staked in position in the outer lever 40. Respective outer rollers 48A, 48B which form second cam contact surfaces are separately mounted on an outer side 50A, 50B of each of the two outer arms 42A, 42B. As shown in FIGS. 2 and 3, aligned holes 52A, 52B extend through the two outer arms 42A, 42B, and respective first sleeves 54A, 54B extend into the holes 52A, 52B in each of the two outer arms 42A, 42B. The outer rollers 48A, 48B are supported by bearing needles 49 that are radially supported on the first sleeves 54A, 54B.

In the first embodiment, the first sleeves 54A, 54B include radially extending flanges 55A, 55B that are located on a pocket side of each of the two outer arms 42A, 42B.

Additionally, two retainers 56A, 56B are preferably also provided, with each including a radially extending retainer flange 57A, 57B. The retainers 56A, 56B are press fit into respective ones of the first sleeves 54A, 54B, and the retainer flanges 57A, 57B axially retain the outer rollers 48A, 48B and the needles 49 in position. The pressing in of the retainers 56A, 56 B into the respective first sleeves 54A, 54B causes a slight expansion of the outer diameter of the first sleeves 54A, 54B which is taken into account as part of the forming of the first sleeves 54A, 54B so that the bearing race provided by the outer surface of each of the first sleeves 54A, 54B is correctly sized.

The first sleeves 54A, 54B as well as the retainers 56A, 56B are preferably made of a bearing grade steel, and can be formed as drawn or punched parts that are heat treated and tempered. Other materials could also be used.

This embodiment of the finger follower 10 provides a simple assembly for the outer lever 40 which can be preassembled with the outer rollers 48A, 48B, as well as provides for roller bearings support of the outer rollers 48A, 48B.

In order to reduce weight and control the expansion of the first sleeves 54A, 54B in the area of the needles 49 that support the outer rollers 48A, 48B, the retainers 56A, 56B can be formed as sleeves.

Still with reference to FIGS. 1-3, a lost motion spring 60A, and preferably two lost motion springs 60A, 60B, are connected between the inner lever 20 and the outer lever 40 in order to absorb the lost motion between the inner lever 20 and the outer lever 40 when they are not locked together, as described below.

A coupling device 70 is located on one of the inner lever 20 or the outer lever 40 on an end opposite from the pivot axel 46. In this embodiment, the coupling device 70 is located on the outer lever 40 and the coupling device 70 includes a coupling pin 72 arranged to move between the locking position, in which the inner lever 20 and the outer lever 40 are connected together for movement at least in an activation direction of a valve, and an unlocked position, in which the inner lever 20 is pivotable relative to the outer lever 40, and the loss motion spring(s) 60A, 60B absorb the lost motion. The coupling device 70 can be of any known type, such as disclosed in U.S. Pat. No. 10,196,944; DE 10 2017 129 874 A1; or DE 10 2017 130 277 A1, all of which are incorporated herein by reference as if fully set forth. Other types of coupling devices could also be used.

Figure 4:
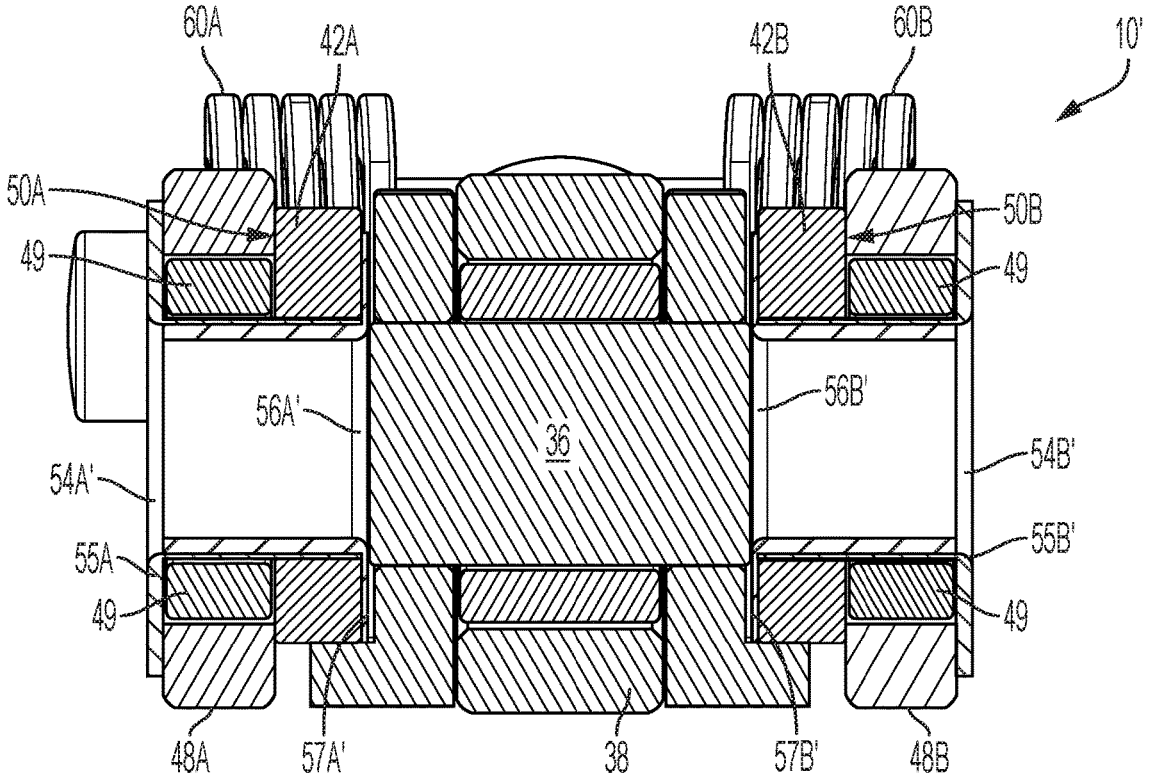
FIG. 4 is a cross-sectional view similar to FIG. 2 of a second embodiment of the switchable finger follower.

A second embodiment of the switchable roller finger follower 10' is shown in FIG. 4. The switchable roller finger follower 10' has the same basic construction as the switchable roller finger follower 10 with the exception of the construction of the first sleeves and the retainers. In this embodiment, as shown in FIG. 4 the first sleeves 54A', 54B' include radially extending the flanges 55A', 55B' that are located outside of the rollers 48A, 48B, and axially retain the outer rollers 48A, 48B and the needles 49. Additionally, two retainers 56A', 56B' are provided, with each including a radially extending retainer flange 57A', 57B'. The retainers 56A', 56B' are press fit into respective ones of the first sleeves 54A', 54B', and the retainer flanges 57A', 57B' are located on a pocket side of each of the two outer arms 42A, 42B. As in the first embodiment, the retainers 56A', 56B' may be formed as sleeves in order to save weight and control expansion of the first sleeves 54A', 54B' during the press fit process. The first sleeves 54*a*', 54B' and the retainers 56A', 56B' are preferably also made from bearing grade steel that is punched or drawn, and then heat treated and tempered. Other materials could also be used.

This arrangement of the finger follower 10' also allows preassembly of the outer lever 40 with the outer rollers 48A, 48B prior to assembly with the inner lever 20.

Figure 5:
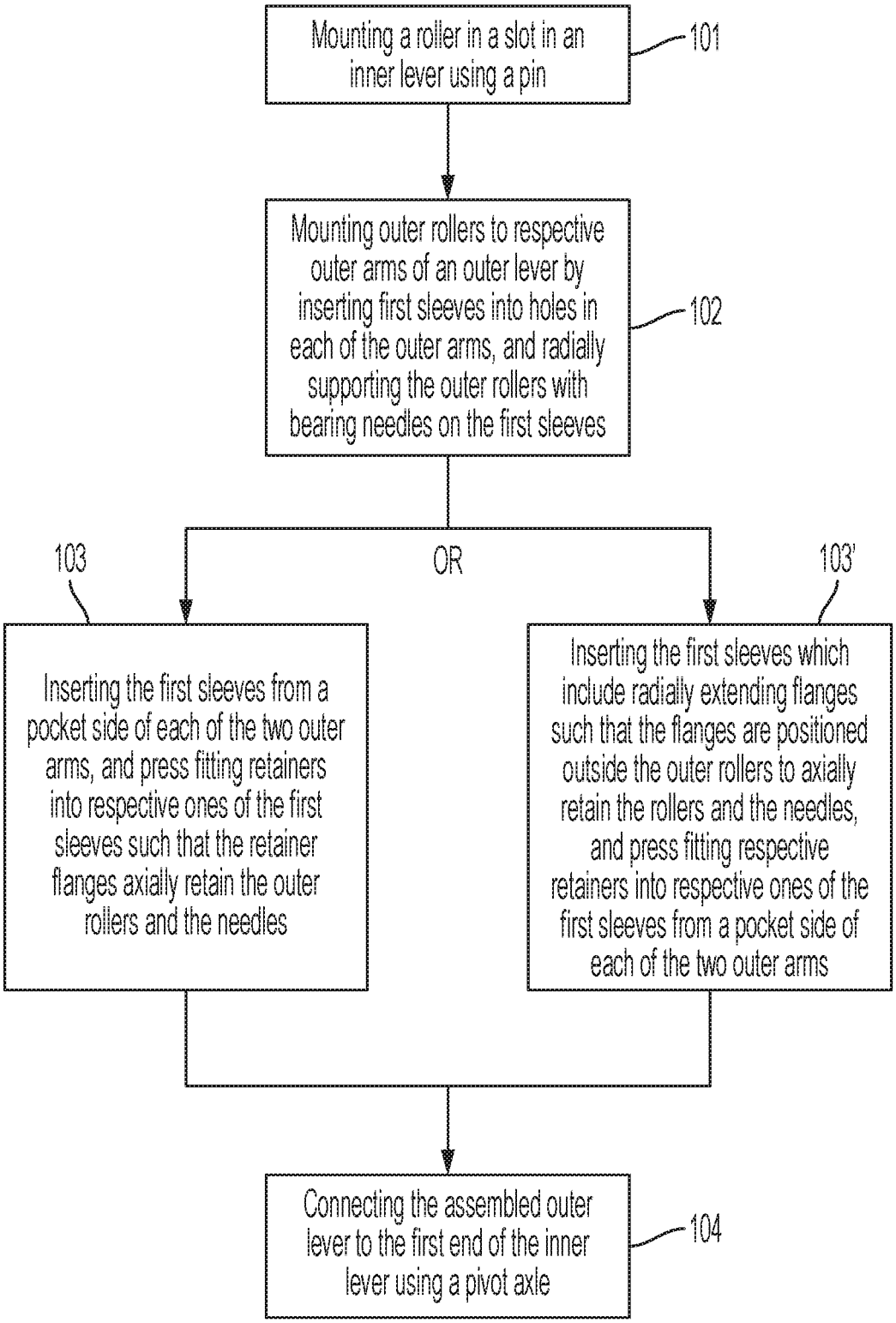
FIG. 5 is a flow chart illustrating a method of assembling the switchable finger follower.

Referring to FIG. 5, a method of assembling a switchable roller finger follower 10, 10' as discussed above is provided. The method includes the steps of mounting the roller 38 in the slot 26 in the inner lever 20 using a pin 36, as shown at 101. The method then includes mounting the outer rollers 48A, 48B to the respective outer arms 42A, 42B of the outer lever 40 by inserting first sleeves 54A, 54B; 54A', 54B' into holes in each of the outer arms 42A, 42B, and radially supporting the outer rollers 48A, 48B with bearing needles 49 on the first sleeves 54A, 54B; 54A', 54B', as shown at 102.

As shown at 103, the first sleeves 54A, 54B may include radially extending flanges and the sleeves 54A, 54B are inserted from a pocket side of each of the two outer arms 42A. 42B, and retainers 56A, 56B are press fit into respective ones of the first sleeves 54A, 54B, such that the retainer flanges 57A, 57B axially retain the outer rollers 48A, 48B and the needles 49. Alternatively, as shown at 103', the first sleeves 54A', 54B' which include radially extending flanges 55A', 55B' are positioned with the flanges outside the outer rollers 48A, 48B to axially retain the rollers 48A, 48B and the needles 49, and respective retainers 56A', 56B' are press fit into respective ones of the first sleeves 54A', 54B' from a pocket side of each of the two outer arms 42A, 42B.

As shown at 104, once the outer lever 40 is assembled, it is connected to the first end 22 of the inner lever 20 via the pivot axle 46.

The locking mechanism 70 can be assembled to one of the inner or the outer levers 20, 40 either prior to or after assembly of the inner lever 20 with the outer lever 40 in order to form the complete switchable roller finger follower 10, 10'.

While the exemplary embodiments have been described in detail, those skilled in the art will recognize that other changes could be made to the switchable roller finger follower without departing from the scope of the present invention. Other types of coupling arrangements could be provided and the specific configuration of the inner lever and outer arms could be varied without departing from the scope of the present invention. Accordingly, the scope of the invention should not be limited by the exemplary embodiments discussed above and instead should be defined by the claims as noted below.

What is claimed is:

1. A switchable roller finger follower having at least two lift modes for a valve train of an internal combustion engine, comprising:

an inner lever having first and second ends, a slot between the first and second ends, and a roller mounted in the slot;

an outer lever with a pocket defined by two outer arms that extend along longitudinal sides of the inner lever, the outer lever being mounted for pivoting movement at the first end of the inner lever by a pivot axle, and a respective outer roller separately mounted on an outer side of each of the two outer arms;

a lost motion spring connected between the inner lever and the outer lever;

a coupling device located on one of the inner lever or the outer lever on an end opposite from the pivot axle, the coupling device includes a coupling pin arranged to move between a locking position, in which the inner lever and the outer lever are connected together for movement at least in an activation direction of a valve, and an unlocked position, in which the inner lever is pivotable relative to the outer lever;

aligned holes extend through the two outer arms;

respective first sleeves extend into the holes in each of the two outer arms; and the outer rollers are supported by bearing needles that are radially supported on the first sleeves.

2. The switchable roller finger follower of claim 1, wherein the first sleeves include radially extending flanges that are located on a pocket side of each of the two outer arms.

3. The switchable roller finger follower of claim 1, further comprising two retainers, each including a radially extending retainer flange, the retainers being press fit into respective ones of the first sleeves, and the retainer flanges axially retain the outer rollers and the needles.

4. The switchable roller finger follower of claim 3, wherein the retainers are formed as sleeves.

5. The switchable roller finger follower of claim 1, wherein the first sleeves include radially extending flanges that are located outside of the outer rollers and axially retain the outer rollers and the needles.

6. The switchable roller finger follower of claim 5, further comprising two retainers, each including a radially extending retainer flange, the retainers being press fit into respective ones of the first sleeves, and the retainer flanges being located on a pocket side of each of the two outer arms.

7. The switchable roller finger follower of claim 6, wherein the retainers are formed as sleeves.

8. A method of assembling a switchable roller finger follower including an inner lever having first and second ends, a slot between the first and second ends, and a roller mounted in the slot, an outer lever with a pocket defined by two outer arms that extend along longitudinal sides of the inner lever and connected for pivoting movement at the first end of the inner lever by a pivot axle, and a respective outer roller separately mounted on an outer side of each of the two outer arms, a lost motion spring connected between the inner lever and the outer lever, and a coupling device located on one of the inner lever or the outer lever on an end opposite from the pivot axle, the coupling device includes a coupling pin arranged to move between a locking position, in which the inner lever and the outer lever are connected together for movement at least in an activation direction of a valve, and an unlocked position, in which the inner lever is pivotable relative to the outer lever, the method comprising:

mounting the roller in the slot in the inner lever using a pin;

mounting the outer rollers to the respective outer arms by inserting first sleeves into holes in each of the two outer arms, and radially supporting the outer rollers with bearing needles on the first sleeves; and connecting the outer lever to the first end of the inner lever with the pivot axle.

9. The method of claim 8, wherein the first sleeves include radially extending flanges, and the sleeves are inserted from a pocket side of each of the two outer arms.

10. The method of claim 9, further comprising press fitting a respective retainer, each including a radially extending retainer flange, into respective ones of the first sleeves, such that the retainer flanges axially retain the outer rollers and the needles.

11. The method of claim 8, wherein the first sleeves include radially extending flanges, and the method includes positioning the flanges outside of the outer rollers to axially retain the outer rollers and the needles.

12. The method of claim 11, further comprising press fitting a respective retainer, each including a radially extending retainer flange, into respective ones of the first sleeves from a pocket side of each of the two outer arms.

13. A switchable roller finger follower having at least two lift modes for a valve train of an internal combustion engine, comprising:

an inner lever having first and second ends, a slot defined between the first and second ends, and a roller mounted on an axle in the slot;

an outer lever with a pocket defined by two outer arms that extend along longitudinal sides of the inner lever, the outer lever being mounted for pivoting movement at the first end of the inner lever by a pivot axle, and a respective outer roller separately mounted on an outer side of each of the two outer arms;

a lost motion spring connected between the inner lever and the outer lever;

a coupling device located on one of the inner lever or the outer lever on an end opposite from the pivot axle, the coupling device includes a coupling pin arranged to move between a locking position, in which the inner lever and the outer lever are connected together for movement at least in an activation direction of a valve, and an unlocked position, in which the inner lever is pivotable relative to the outer lever;

respective first sleeves extend from each of the two outer arms; and the outer rollers are supported on the first sleeves.

14. The switchable roller finger follower of claim 13, wherein the first sleeves extend through aligned holes in each of the outer arms.

15. The switchable roller finger follower of claim 13, wherein the first sleeves include radially extending flanges that are located on a pocket side of each of the two outer arms.

16. The switchable roller finger follower of claim 13, further comprising two retainers, each including a radially extending retainer flange, the retainers being press fit into respective ones of the first sleeves, and the retainer flanges axially retain the outer rollers.

17. The switchable roller finger follower of claim 16, wherein the retainers are formed as sleeves.

18. The switchable roller finger follower of claim 13, wherein the first sleeves include radially extending flanges that are located outside of the outer rollers and axially retain the outer rollers.

19. The switchable roller finger follower of claim 18, further comprising two retainers, each including a radially extending retainer flange, the retainers being press fit into respective ones of the first sleeves, and the retainer flanges being located on a pocket side of each of the two outer arms.

* * * * *